United States Patent [19]

Kearney et al.

[11] Patent Number: 4,544,013

[45] Date of Patent: Oct. 1, 1985

[54] METHOD OF RECLAIMING SAND USED IN EVAPORATIVE CASTING PROCESS

[75] Inventors: Dolores C. Kearney, Inkster; Peter Giza, Livonia; Bruno Matz, Milford, all of Mich.

[73] Assignee: Ford Motor Company, Dearborn, Mich.

[21] Appl. No.: 549,131

[22] Filed: Nov. 7, 1983

[51] Int. Cl.[4] ..... B22C 9/02

[52] U.S. Cl. ..... 164/5; 164/34

[58] Field of Search ..... 164/5, 34, 35; 432/15, 432/58; 264/221, 313, DIG. 44; 425/DIG. 12

[56] References Cited

U.S. PATENT DOCUMENTS

| | | | |
|---|---|---|---|
| 3,042,973 | 7/1962 | Brockhues et al. | 264/51 |
| 3,222,738 | 4/1963 | Carter | 164/34 |
| 3,417,170 | 12/1968 | Knapp | 264/51 |
| 3,419,648 | 8/1965 | Leach | 264/53 |
| 3,557,867 | 1/1971 | Krzyzanowski | 164/255 |
| 3,581,802 | 6/1971 | Krzyzanowski | 164/34 |
| 3,737,266 | 6/1973 | Yamamoto | 249/14 |
| 3,738,415 | 6/1973 | Planten | 164/5 |
| 3,842,899 | 10/1974 | Hauser-Lienhard | 164/253 |
| 3,941,528 | 3/1976 | Cotterell | 425/4 R |
| 4,222,429 | 9/1980 | Kemp | 164/34 |
| 4,325,424 | 4/1982 | Scheffer | 164/5 |
| 4,457,352 | 6/1984 | Scheffer | 164/5 |
| 4,508,277 | 4/1985 | Andrews | 164/5 |

OTHER PUBLICATIONS

"Marks' Standard Handbook for Mechanical Engineers", 8th Ed., pp. 4–60.

*Primary Examiner*—Nicholas P. Godici
*Assistant Examiner*—G. M. Reid
*Attorney, Agent, or Firm*—Joseph W. Malleck; Roger L. May

[57] ABSTRACT

The invention is a method of reclaiming sand used in a method of casting a metal having a liquidus temperature below 2000° F., the casting method using a vaporizable pattern set within a mold constituted of unbonded sand. The method comprises: (a) blowing, after a predetermined lapse of time after the pouring of the metal into the mold, a combustion supporting gas into and through substantially the entire volume of the mold to levitate at least a region of the sand adjacent to the casting and to combust volatilized byproducts of the pattern entering the mold, and (b) continuing the blowing of the combustion supporting gas to continue combustion and driving of the gas and byproducts of the combustion out of the mold.

7 Claims, No Drawings

METHOD OF RECLAIMING SAND USED IN EVAPORATIVE CASTING PROCESS

TECHNICAL FIELD

This invention relates to the technology of reclaiming unbonded sand and to the art of making nonferrous castings by use of consumable or evaporative patterns.

BACKGROUND OF THE INVENTION AND PRIOR ART STATEMENT

The use of patterns that are volatilized by the heat of molten metal poured into the cavity containing the pattern (such as polystyrene) has been known for some time. This process depends upon the use of dry, unbonded sand particles to form the mold walls. The minute crevices between the sand particles of the mold walls act as passageways for the hot gaseous or liquified products of the evaporation of the pattern to migrate out of the casting cavity.

Unfortunately the sand mold, being an insulator, sets up a temperature gradient which causes the volatilized products to quickly cool and condense on the sand particles of which the mold is constituted. Such condensation contaminates the sand for subsequent reuse in the casting process and must be subjected to costly independent reclamation procedures, which may or may not return the sand to its original condition. The contamination is particularly prevalent when casting metals having a liquidus below 2000° F. because the decomposition products of the pattern more readily contain liquids which cannot be carried out from the sand by a gas exhaust.

The prior art has used gas flows, such as air, to fluidize the sand of the mold, principally for the purpose of allowing for the insertion of the pattern or the removal of the completed casting from the mold (see U.S. Pat. Nos. 3,581,802 and 3,557,867). The prior art has also used a heated positive gas flow, such as air, prior to the pouring of molten metal into a ceramic shell mold, the latter containing a vaporizable pattern. This latter technique softened the pattern only by using heated air flow at a stage before pouring of molten metal; the bulk of the pattern was subsequently removed by insertion of the pattern into a firing furnace, volatilizing the pattern, and allowing the volatilized gases to pass through the shell mold and out into the furnace atmosphere. However, since this procedure was conducted prior to the pouring of the molten metal into the cavity, the positive pressure of the air flow forced vapors that were to form, from the heat conducted thereinto, to pass outwardly through the neck of the ceramic shell mold and not pass through the mold itself into the surrounding sand body (see U.S. Pat. No. 3,222,738). The gases could not pass through the mold because of (a) the positive pressure of the heated air flow surrounding such mold, (b) the vaporized gases were limited in amount, and (c) the gases passed outwardly through the neck of the shell mold which was maintained above the top level surface of the surrounding sand medium. The problem of contaminated sand remains a problem since this technique fails to prevent condensation on sand during a metal pouring operation and because shell molds were not intended for reuse.

SUMMARY OF THE INVENTION

The invention is a method of reclaiming sand which has been used in casting a metal having a liquidus temperature below 2000° F. (such as aluminum), the casting method using a vaporizable pattern set within a mold constituted of unbonded sand. The improvement provides for maintaining the cleanliness of the sand for immediate reuse. The method comprises: (a) after a predetermined lapse of time after the pouring of the metal into the mold to form a casting, blowing a combustion supporting gas into and through the mold to fluidize at least the region of sand adjacent to the casting and to combust volatilized byproducts of the pattern in said region of sand about the casting, and (b) continuing the blowing of the combustion supporting gas to continue combustion, additional volatilization of byproducts, and driving of the gaseous products of the combustion out of the mold.

Advantageously, the reclamation improvement may be optimized by blowing the combustion supporting gas immediately after a period of time permitting the molten metal to substantially solidify throughout at least its outer surface to form a skin and preferably for a minimum period of 5–10 minutes so as to not disrupt the sand during such solidification process. The blowing is preferably carried out to not only levitate and thoroughly loosen the entire body of mold sand for eventual removal of the casting, but also to combust and carry away the gases and byproducts so formed.

Preferably, the blowing of the combustion supporting gas is carried out at a gas pressure of 5–20 psi when the sand is fine grained and 20–45 psi when the sand grains are coarse. Advantageously, the combustion supporting gas may be preheated prior to being blown into the mold, such preheating conditioning the combustion supporting gas to a temperature level of 500°–800° F.

BEST MODE FOR CARRYING OUT THE INVENTION

A preferred method for carrying out the invention is as follows.

1. Setting Vaporizable Pattern in Unbonded Sand Mold

A pattern is used of the type which is consumed by contact with the molten metal for the casting. Such patterns can be made of relatively inexpensive material and is typically comprised of polystyrene which can be formed into a pattern body in conformity with the prior art (see U.S. Pat. Nos. 3,042,973; 3,419,648; 3,417,170; 3,941,528; and 3,737,266, the disclosures of which are incorporated herein by reference). Essentially, beads of polystyrene are heated in a forming container and expanded by the heat and/or steam to the shape desired.

The shaped pattern is placed in a cylindrical flask of the type that has solid side walls and is open to atmosphere at its top. At its bottom is defined a pressure equalizing chamber into which can be injected a gas, such gas entering the interior of the flask through a foraminous (porous) plate at the bottom of the flask. Either the openings within the foraminous plate are smaller than the grains of sand used as the molding material therein, or a screen is added to the plate to prevent the grains from falling through.

The pattern is inserted into position within the flask and held there by a robotic hand. Sand is then introduced to the interior of the flask by a plurality of gravity filling tubes (such as four tubes) lowered into the flask in close proximity to the plate of the flask. As sand fills the flask, the tubes are progressively raised to allow gravity filling to continue to completion. During a later stage of filling (as well as after filling), the flask is vibrated to cause the grains to agitate, settle and rock together. The sand grains, being irregular in shape, produce the locking effect (see U.S. Pat. Nos. 3,581,802 and 3,842,899 for disclosure implementing the vibration aspect of pattern setting and sand locking, the disclosures of which are incorporated herein by reference). Channels are left within the sand mold to define a runner system and sprue for introducing molten metal to the pattern, such channels may, of course, be formed by an extension of the pattern itself as a gating system or neck. Such neck facilitates gripping of the pattern by the robot during positioning in the flask.

2. Pouring Molten Metal

The casting is then formed by pouring molten metal having a liquidus below 2000° F. (preferably aluminum) into the mold cavity to contact the vaporizable pattern. For purposes of this embodiment, an aluminum alloy of substantially SAE 319 was used and held at a pouring temperature of 1250° F. for a cylinder head casting (or 1600° F. for an intake manifold casting having thinner sections). As a result of the heat of the molten aluminum, the polystyrene and its constituents were volatilized along with the formation of some other major types of liquids, including benzene, toluene, or styrene. There may be as many as 20 to 30 other minor compounds formed as a derivative of the polystyrene as a result of the heat and some chemical reaction between the molten metal and the pattern itself.

The liquids and gases are forced out of the mold cavity defined by the pattern because of the force of the entering aluminum metal. The gases migrate through the sand mold, through the interstices thereof; the liquids do similarly, but their migration is somewhat more limited. Some of the gases are chilled by the temperature gradient in the mold and are condensed to a liquid when their initial temperature is relatively low as a gas. Typically, the sand grains located a distance of about one inch from the inner mold surface will reach a temperature of 1200°–1400° F. within a span of time of 5–10 minutes after the pouring of the molten metal thereinto. Much of the sand is heated by radiation. Within the adjacent distance of 2–3 inches from the inner mold surface, the temperature of the mold will be in the range of 500°–1000° F. Most frequently, the combustion supporting gas is blown into at least the region of sand in which the temperature ranges from 1400°–800° F. after the lapse of time to form a skin on the casting.

3. Blowing Combustion Supporting Gas Through the Sand Mold

After the molten metal has solidified along at least its outer surface to form a skin so that movement of forced gas through the sand will not disrupt the definition of the casting (such as 5–10 minutes), a combustion supporting gas (air) is introduced to the pressure equalizing chamber below the sand mass and forced through the foraminous plate into the sand mass. The air is blown into at least the region of the sand mass adjacent the casting to fluidize (levitate) the sand in such region. Optimally, substantially the entire volume of sand in the mold is fluidized. When a fine grain is used (having a particle size in the range of AFS 45–100), the air pressure employed may be in the range of 5–20 psi. When larger grained sand is employed (having a particle size in the range of 25–40 AFS), greater pressure is employed in the range of 20–45 psi so as to effectively lift and levitate the particles of sand. The flow of air injected thereinto will depend upon the volume of sand that must be lifted for fluidization. For purposes of the preferred mode, a sand volume of 15 cubic feet (a column of about 36 inches) was levitated by use of a flow rate of 700 cfm, the sand had coarse grains and the foraminous plate had air holes of about 0.062 inches in diameter. With fine grain sand the flow rate would be about 200 cfm.

The hot liquids as well as the volatilized gases are of sufficient temperature so that when the combustion supporting gas is brought into contact therewith additional combustion or volatilization of the pattern products will further take place by exothermic reaction, heating the sand even further, and ensuring that all of the byproducts of the pattern will be gasified.

4. Continuing the Blowing to Drive All Gaseous Product Therefrom

With all of the byproducts in the gaseous form as a result of sustained combustion in the sand mold, the volatilized products will be driven out of the sand mold, up through its top, by virtue of continuing the blow for a period of time, typically about 5–10 minutes.

It may be advantageous to preheat the combustion supporting gas prior to introduction into the air equalizing chamber so as to enhance combustion of the byproduct liquids. If the liquids have cooled by such an extent so that the mere contact of oxygen or air would not be sufficient to carry out combustion, then such preheating is helpful so as to have the proper reaction temperature.

EXAMPLES

As shown in Table 1, a series of samples were prepared and tested to establish the operability of the present invention. Each of the samples had consumable patterns prepared according to that of the preferred mode and were introduced into a flask and set in a sand mold body according to the preferred mode. Aluminum metal of substantially type SAE 319 was poured at a pouring temperature of 1400°–1450° F. into a mold containing the pattern. The variables for the samples were the pattern volume, the grain size of the mold sand and gas blow (as to the use of either air, oxygen, or no gas for the blowing operation, and the time as well as the pressure and flow volume). The success or lack of success of the method is established in column 6 which exhibits loss on ignition, a test which represents the amount of combustible material (such as organic material) present in the sand after having been subjected to the process of this invention. It is desirable if the loss on ignition is less than 1% if the sand/metal ratio is high. If the sand/metal ratio is small, the loss on ignition should be less than 0.5%. As you can see, samples 1, 3 and 4 had very little loss on ignition and thus were considered satisfactorily clean sand after the casting operation, while samples 2 and 5 showed a significantly troublesome loss on ignition, demonstrating that the sand was not totally cleansed of combustible compounds. Such loss on ignition for sample 2 was due to the fact that no combustible gas was employed following the pouring of the molten metal, and sample 5 used too low a flow of combustible gas for a coarse sand to establish elimination of the volatile materials from the sand. If the sand has a high combustible material content (indicative of a high loss on ignition), then, upon reuse in a molding operation, the sand will be (a) sticky, leading to insufficient compaction during vibration and insufficient filling of internal passages in the pattern; and (b) molten metal contacting the contaminated sand will be heated up locally and possibly cool nonuniformly causing casting defects.

TABLE 1

| Sample | Pattern Volume | Grain Size of Mold Sand | Gas Blow Type/Time | Gas Blow Press./CFM of Flow | Loss On Ignition |
|---|---|---|---|---|---|
| 1 | 500 cc | fine | air/5 min. | 5 psi/200 | low |
| 2 | 500 cc | fine | none | — | high |
| 3 | 1000 cc | fine | $O_2$/5 min. | 7 psi/225 | low |
| 4 | 1000 cc | coarse | air/10 min. | 45 psi/700 | low |
| 5 | 1000 cc | coarse | air/10 min. | 5 psi/200 | high |

We claim:

1. A method of reclaiming sand used in casting a metal having a liquidus temperature below 2000° F., the casting method using a vaporizable pattern set within a mold constituted of unbonded sand, comprising:

(a) blowing, after a lapse of time of about 5–10 minutes after the pouring of molten metal into said mold to form a casting, a combustion supporting gas into and through said mold to fluidize at least the region of said sand adjacent to the casting in which the temperature ranges from 1400°–800° F. and thereby to utilize the radiant heat of said molten metal to combust volatilized byproducts of said pattern in said region of sand about the casting; and (b) continuing the blowing of said combustion supporting gas to continue combustion, additional volatilization of byproducts, and driving of said gas and products of combustion out of said mold.

2. The method of claim 1, in which said metal is aluminum or an aluminum based metal.

3. The method of claim 1, in which said blowing in step (b) is started immediately after a solidified skin is formed on said molten metal casting.

4. The method as in claim 3, in which some portion of said casting remains unsolidified and in place in said mold throughout steps (a) and (b).

5. The method of claim 1, in which said blowing of a combustion supporting gas is carried out into and through substantially the entire volume of said mold and with sufficient force to fluidize all of the mold sand during the blowing.

6. The method of claim 1, in which said blowing is carried out at a gas pressure of 5–20 psi when said mold sand is fine grained, and 20–45 psi when said sand particles are coarse grained.

7. The method of claim 1, in which said combustion supporting gas is preheated prior to blowing into said mold in step (a).

* * * * *